US009322119B2

(12) United States Patent
Erdem et al.

(10) Patent No.: US 9,322,119 B2
(45) Date of Patent: Apr. 26, 2016

(54) NONWOVEN WEBS MADE FROM TREATED FIBERS

(76) Inventors: Gueltekin Erdem, Schwalbach am Taumus (DE); Michael Jan Trinkaus, Bad Soden (DE)

( * ) Notice: Subject to any disclaimer, the term of this patent is extended or adjusted under 35 U.S.C. 154(b) by 0 days.

(21) Appl. No.: 12/142,197

(22) Filed: Jun. 19, 2008

(65) Prior Publication Data

US 2008/0319407 A1 Dec. 25, 2008

(30) Foreign Application Priority Data

Jun. 19, 2007 (EP) ..... 07110505

(51) Int. Cl.

| | |
|---|---|
| ***A61F 13/15*** | (2006.01) |
| ***A61F 13/20*** | (2006.01) |
| ***D04H 1/42*** | (2012.01) |
| ***D04H 1/425*** | (2012.01) |
| ***D04H 1/4258*** | (2012.01) |
| ***D04H 1/4266*** | (2012.01) |
| ***D04H 1/492*** | (2012.01) |
| ***D04H 1/74*** | (2006.01) |

(52) U.S. Cl.

CPC ..... *D04H 1/42* (2013.01); *D04H 1/425* (2013.01); *D04H 1/4258* (2013.01); *D04H 1/4266* (2013.01); *D04H 1/492* (2013.01); *D04H 1/74* (2013.01); *Y10T 442/608* (2015.04); *Y10T 442/696* (2015.04)

(58) Field of Classification Search

CPC ..... D04H 1/42; D04H 1/425; Y10T 442/608; Y10T 442/696

USPC ..... 604/367

See application file for complete search history.

(56) References Cited

U.S. PATENT DOCUMENTS

| | | | | |
|---|---|---|---|---|
| 3,381,688 A * | 5/1968 | Satas | ..... | 502/407 |
| 4,256,111 A * | 3/1981 | Lassen | ..... | 604/368 |

(Continued)

FOREIGN PATENT DOCUMENTS

| | | | | |
|---|---|---|---|---|
| EP | 1 091 035 A1 * | 4/2001 | ..... | D04H 1/46 |
| EP | 1418268 | 5/2004 | | |
| WO | WO 91/05108 | 4/1991 | | |

OTHER PUBLICATIONS

C. Kaewprasit, 1998, Quality Measurements Application of Methylene Blue Adsorption to Cotton Fiber Specific Surface Area Measurement: Part I. Methodology, The Journal of Cotton Science, 2:164-173.*

(Continued)

*Primary Examiner* — Michele M Kidwell

(74) *Attorney, Agent, or Firm* — William E. Gallagher; Kelly L. McDow; Betty J. Zea

(57) ABSTRACT

The invention relates to a nonwoven web with superior initial tensile strength. The web constructed from at least one type of fiber that has been modified to increase its specific surface area. The fiber has a specific surface area of at least 55 $m^2/g$. The invention also relates to use of the nonwoven web with superior initial tensile strength for the making of a disposable absorbent article. These include, diapers, training pants, incontinence pants, tampons, female hygiene pads and wipes.

7 Claims, 2 Drawing Sheets

(56) References Cited

U.S. PATENT DOCUMENTS

| | | | | |
|---|---|---|---|---|
| 5,199,134 | A | 4/1993 | Ripley | |
| 5,393,304 | A | 2/1995 | Vuillaume et al. | |
| 5,824,364 | A | 10/1998 | Cousin et al. | |
| 5,865,822 | A * | 2/1999 | Hamajima et al. | 604/367 |
| 2001/0053899 | A1 * | 12/2001 | Mizutani et al. | 604/374 |
| 2002/0124366 | A1 | 9/2002 | Hirsch | |
| 2003/0035785 | A1 * | 2/2003 | Palumbo et al. | 424/70.28 |
| 2006/0275251 | A1 * | 12/2006 | Santar et al. | 424/78.27 |
| 2008/0108265 | A1 * | 5/2008 | Pourdeyhimi et al. | 442/189 |

OTHER PUBLICATIONS

Forziati, Florence, Mar. 1953, Journal of Research of the National Bureau of Standards, vol. 50, No. 3, pp. 139-145; Surface Areas of Cottons and Modified Cottons Before and Aftew Swelling as Determined by Nitrogen Sorption.*

Kaewprasit et al., *Journal of Cotton Science*, "Quality Measurements," (1998), pp. 164-173.

* cited by examiner

NONWOVEN WEBS MADE FROM TREATED FIBERS

CROSS REFERENCE TO RELATED APPLICATION

This application claims priority to European Patent Application 07110505.0, filed Jun. 19, 2007, the substance of which is incorporated herein by reference.

FIELD OF THE INVENTION

This invention relates to the construction of nonwoven webs, formed from at least one type of fiber with high surface area. The resulting webs exhibit superior strength and may be used to make disposable absorbent hygiene articles with superior strength and cleaning performance. The present invention enables the creation of stronger disposable absorbent hygiene articles, such as cleaning articles suitable for all types of cleaning, including for personal (both therapeutic and cosmetic), domestic and industrial purposes, including dry and wet wipes

BACKGROUND OF THE INVENTION

Nonwoven materials span a diverse range of physical properties and are widely used for a variety of diverse products. Some examples of nonwoven products are, disposable clothing, geo-textiles, insulation, filters, carpet underlay or backing, pillows cushions and upholstery padding and disposable absorbent hygiene articles such as diapers, training pants, female pads and tampons, both wet and dry wipes as well as adult incontinence products.

Nonwoven materials or webs can be manufactured from a wide range of different fibers both man made (synthetic) and natural but the majority are constructed from man made fibers and in particular polypropylene and polyesters (mainly PET).

Nonwoven materials can be manufactured via a range of processes, including wet laying and dry laying techniques such as carding, spun-laying, and air-laying followed by a bonding process to add strength. Although not limited to, this is typically achieved via four different general process types, thermal bonding, hydroentanglement, needlefelt (or needlepunch) and chemical or adhesive bonding.

While the market for nonwoven materials for articles of clothing and hygienic articles such as diapers, wipes and pads, has been largely dominated by the use of predominantly synthetic fiber webs, nonwovens constructed from entirely natural fibers are not unknown.

Nonwovens manufactured from cellulosic fibers like cotton are known in the art. For example U.S. Pat. No. 5,199,134, which discloses a system and method for producing a bleached cotton, nonwoven web.

Natural fibers like cotton are particularly prized because they yield webs that are absorbent and soft compared with the equivalent synthetic webs. Natural fibers such as cotton fibers are also biodegradable. These properties have particularly lead to their use in medical applications such as disposable sheets, blankets, surgical gowns and bandages.

Natural fibers like cotton are also desirable for use in the manufacture of nonwoven products, such as in disposable absorbent hygiene articles such as diapers, training pants, female pads and tampons, both wet and dry wipes and adult incontinence products, as they are perceived to be softer and more environmentally friendly by consumers.

It is also desirable, when manufacturing disposable absorbent hygiene articles to utilize hydroentanglement when bonding the fibers in the web. Without being bound by theory, it is believed that hydroentanglement processes yield webs which are softer and have increased drape relative to other known bonding processes, such as thermal-bonding and adhesive bonding.

However hydroentanglement of pure cotton nonwovens is known to result in nonwovens which are mechanically weak and typically have a low resistance to abrasion when wet. Cotton fibers may be blended with synthetic fibers to improve the mechanical properties of the resulting nonwovens. Alternatively binders or resins can be added to improve the durability of the products. U.S. Pat. No. 5,393,304 details using 0.2-1% by weight of a polyamide-amine-epichlorohydrin (PAE) resin on cotton based nonwovens to enable them to be repeatedly laundered without disintegration.

Separately, cotton fibers can be acquired from a number of sources. These sources include, but are not limited to, virgin or fresh cotton fibers and recycled or reclaimed cotton fibers. For example, US 2002/0124366 discloses a system for reconstituting fibers from recycled waste fabric material, including cotton denim waste. The fibers are returned to a substantially virgin state and can be successfully incorporated into hydroentangled or needlepunched nonwoven products without the need for binders or additives.

SUMMARY OF THE INVENTION

The invention describes the formation of nonwoven webs suitable for the production of disposable absorbent articles possessing a superior initial tensile strength. The webs are formed from fibers that have been treated to increase their specific surface area. Webs formed from these fibers demonstrate advantageous properties of increased initial tensile strength when compared with equivalent webs formed from untreated fibers.

DETAILED DESCRIPTION OF THE INVENTION

Figure 1:
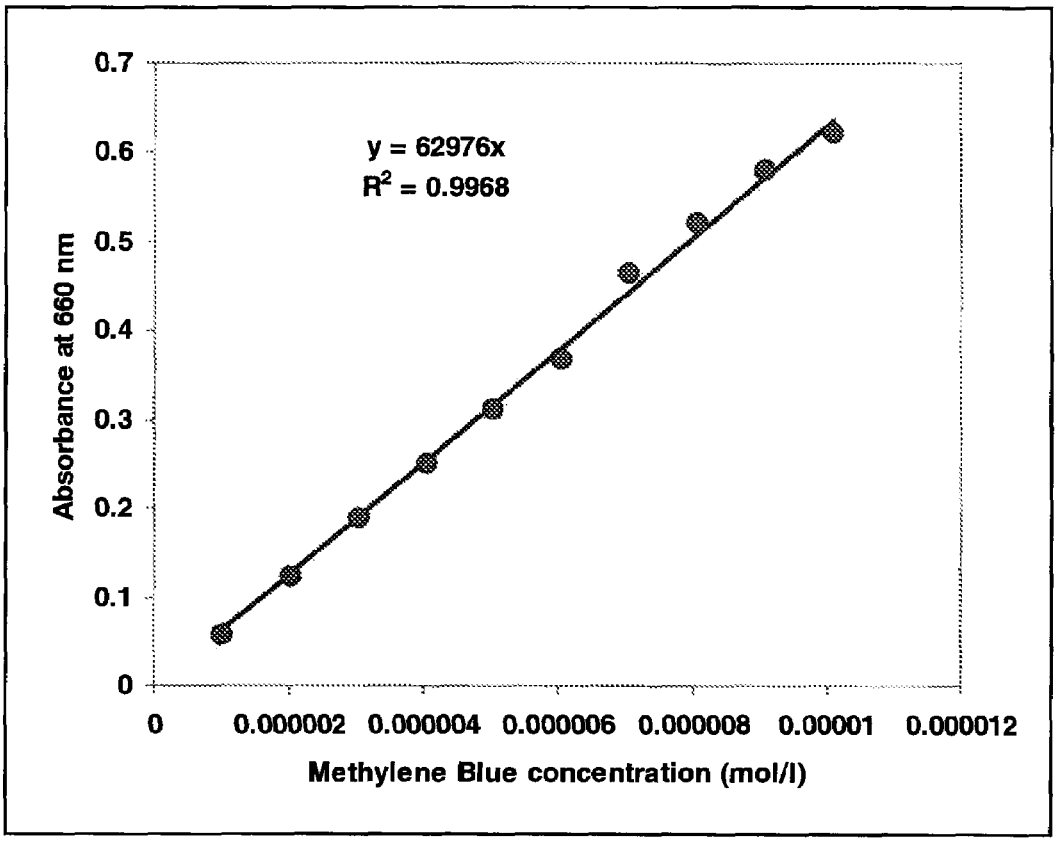
FIG. 1 shows a calibration curve of methylene blue concentration against absorbance at 660 mm.

All percentages quoted are weight per weight unless otherwise stated.

The term "specific surface area" as used herein is defined as the accessible area of solid surface per unit mass of material. The measurement of the specific surface areas of the cotton fibers in the present invention refers to those calculated have with a "methylene blue" (3,7-bis-dimethylamino-phenothiazin-5-ium ion) adsorption technique outlined in the test section below.

The term "nonwoven" as used herein defines webs that have a basis weight of between 10 and 140 grams per square meter ($g/m^2$). They can be constructed from a wide variety of different fiber types including both natural and synthetic and can be made from a single fiber source or a blend of two or more different types of fibers.

The term "treated" as used herein defines fibers that have been altered to adjust their chemical or physical properties, such as their specific surface area. This may be done through a chemical process or a physical or mechanical process.

The term "machine direction" as used herein is the direction of the nonwoven web in which the fibrous structure is manufactured. Generally, fiber laying processes such as carding, spunbonding, melt-blowing, etc., may result in fiber-orientation parallel to the machine direction.

The term "cross direction" as used herein refers to direction that is substantially perpendicular to the machine direction. Generally, fiber laying processes such as carding, spunbonding, melt-blowing, etc., may result in fiber-orientation perpendicular to the cross direction.

This direction property of nonwoven webs is carefully distinguished herein because the mechanical properties of fibrous structures differ depending on the direction measured.

The term "tensile strength" as used herein is the maximum amount of force as measured in Newton's that a nonwoven or other material can bear without tearing or breaking.

The term "initial tensile strength" as used in the present invention is defined by the following formula:

$$\text{Initial tensile strenth} = \frac{(\text{Force at 20\% Strain} - \text{Force at 2\% Strain})}{(\text{Length at 20\% Strain} - \text{Length at 2\% Strain})}$$

The invention is directed towards the production of a strong nonwoven web with high initial tensile strength in the cross direction. This may be achieved by constructing the nonwoven web from treated fibers. These fibers may be treated to give them a higher specific surface area than the equivalent untreated fibers.

Nonwovens usually display different mechanical properties in their machine and cross directions. The fibers in a for example carded nonwoven are partially orientated lengthways, parallel to the machine direction. This gives the web significantly higher strength when stressed in this direction.

Perpendicular to the machine direction is the cross direction. Without being bound by theory it is believed that the fibers are not bound to each other as well in the cross direction (versus the machine direction) as they are at least partially in a side to side relationship with each other, giving a poorer overlap. This means that the web is weaker in this direction and therefore it is easier to deform the web in the cross direction than the machine direction.

When assessing the quality of a web used in a disposable absorbent article, consumers generally do not test it to destruction, but may try to get a feel for its properties. A key marker for the perceived quality of the web may be the initial response of the web to gentle tension in the weaker cross direction. Any obvious visual deformation of the web seen when grasping in the hands and applying gentle tension parallel to the cross direction, will cause the impression of a weak and/or inferior product. Therefore increasing the ability to resist deformation in the cross direction at low forces is critical for the perception of the quality in a nonwoven web.

The use of fibers with a high specific surface area has been found to give a nonwoven web a significantly higher initial tensile strength. Without wishing to be bound by theory it is believe that using high surface area fibers in the nonwovens has two effects that lead to a higher initial tensile strength. Firstly, better bonding characteristics, the fibers more readily overlap and entwine. This is particularly likely in nonwoven webs in which the fibers are bonded through hydroentanglement. Secondly the increase in surface area increases the friction between the fibers in the nonwoven material. It is believed that the combination of the two effects means that significantly more energy is required to separate the fibers in the nonwoven and that this gives rise to an increase in the initial tensile strength in the cross direction of the web.

The webs can be constructed by any method known in the art, including dry-laying and wet-laying techniques. The bonding steps that can be used include hydroentanglement, needlepunch, chemical or adhesive bonding and thermal bonding. A non-limiting embodiment of the present invention is a nonwoven formed from fibers that are carded and then bonded via hydroentanglement.

Suitable nonwoven substrates can be formed from 100% of fibers that have been treated to increase their surface area or blends of such fibers mixed with untreated fibers. The amount of treated fibers in the web can range from 10%-100%, also from 15%-80%, also from 25%-75%, also from 30%-70% and also from 40%-60%. The high surface area fibers can be mixed with other of the same type, or another type depending on the desired mechanical and other physical properties such as absorbency, softness etc.

Suitable fibers for the construction of the nonwoven webs of the present invention can be any fibers known in the art. The webs can be constructed from a single type or fiber or a blend of two or more fibers. Suitable fibers can be synthetic or naturally derived. A non limiting list of suitable fiber types are, viscose, rayon, polyester, cotton, wood and polypropylene.

In one embodiment, the high specific surface area fibers are cotton fibers.

It is known from the art, *Journal of Cotton Science* 2:164-173 (1998) that fresh cotton fibers have a specific area of up to 53 $m^2/g$.

In the present invention a method has been discovered to increase the specific surface area of treatment to at least 55 $m^2/g$, alternatively at least 60 $m^2/g$, alternatively at least 65 $m^2/g$, alternatively at least 70 $m^2/g$ and alternatively a specific surface greater than 75 $m^2/g$.

The chemical treatment detailed in this invention yields fibers with increased specific surface areas irrespective of the starting surface area of the cotton used. Cotton with a specific surface area as low 17 $m^2/g$ has been successfully increased to >75 $m^2/g$ with this treatment. Table 1 below displays technical properties, including specific surface area, of three samples of cotton.

TABLE 1

Surface Area of the Fibers Calculated From Methylene Blue Adsorption

| Cotton Type | Adsorbed Methylene Blue [monolayer g/g of cotton] | Surface Area [$m^2/g$ of cotton] | Mean Fiber Length [mm] | Micronaire | Maturity Ratio |
|---|---|---|---|---|---|
| Sample 1 | 0.00480 | 17.82 | 14 | 3.6 | 0.73 |
| Sample 2 | 0.00465 | 17.26 | 16 | 4.9 | 0.78 |
| Treated | 0.02100 | 77.94 | 12.9 | 4.8 | 0.74 |

The cotton fibers in Sample 1 have been combed and have therefore been subjected to a moderate mechanical treatment before being bleached. The cotton fibers from Sample 2 were put through additional mechanical cleaning and opening/carding steps before being bleached and can be considered to have been mechanically treated. The fibers from samples 1 and 2 were bleached in the same way and without any additional treatment to increase their specific surface area. The treated fibers are fibers from Sample 2 that have been further subjected to a chemical treatment step (details of the process are in the methods section) to increase their specific surface area.

From the measurements taken it can be shown that the treated fibers have a specific surface area more than four times that of either the fibers in Sample 1 or Sample 2. The mechanical treatment of the fibers can therefore be shown to have a negligible effect on the specific surface area of the cotton fibers.

The increase in surface area shown in the example above is over 400%. Even starting with the surface area cottons as detailed in *Journal of Cotton Science* 2:164-173 (1998) with their higher natural surface area will have their surface area enhanced by this process by a minimum of 10%, alternatively a minimum of 25%, alternatively a minimum of 50%, alternatively a minimum of 100% and alternatively a minimum of 150%.

Two different nonwoven webs were constructed under identical production procedures and conditions with blends of, one viscose and the Sample 1 fibers (from Table 1) and 2), viscose and the treated fibers (from Table 1) for comparison studies. Both webs had a 60 g/m$^2$ basis weight and were constructed from a 60/40 mixture of the viscose (60%) and the cotton (40%). The two webs were examined to record their tensile properties and the results are shown in Table 2 below.

TABLE 2

Comparison of Tensile Properties of the Wipes with Different Cotton Fibers

| Nonwoven (all 60gsm BW) | CD T Fmax [N] (Cross Direction) | MDT Fmax [N] (Machine Direction) | Initial Tensile Strength [N/m/5 cm] (Cross Direction) |
|---|---|---|---|
| 60/40 | 14.2 | 32.1 | 92.2 |
| Viscose/Treated | (0.3) | (1.8) | (9.3) |
| 60/40 | 16.5 | 36.0 | 63.8 |
| Viscose/Sample 1 | (0.5) | (2.0) | (4.8) |

( ) - 95% confidence interval

The 95% confidence interval values are calculated by the equation below:

$$\text{Confidence interval} = \text{mean} \pm 1.96\left(\frac{\text{standard deviation}}{\sqrt{\text{sample size}}}\right)$$

The nonwoven web containing the treated cotton fibers shows approximately a 50% increase in its initial tensile strength in the cross direction when directly compared with an equivalent nonwoven web made from the Sample 1 fibers.

Some examples of nonwoven products are, disposable clothing, geo-textiles, insulation, filters, carpet underlay or backing, pillows cushions and upholstery padding and disposable absorbent hygiene articles such as diapers, training pants, female pads and tampons, both wet and dry wipes as well as adult incontinence products Nonwoven webs containing treated fibers with high surface area may be used in the manufacture of any product which incorporates a nonwoven web in its construction. Examples of such products include but are not limited to disposable clothing, geo-textiles, insulation, filters, carpet underlay or backing, pillows cushions and upholstery padding and disposable absorbent hygiene articles. Nonwoven webs of the present invention are particularly desirable for their use in the construction of disposable absorbent articles, including but not limited to household cleaning articles and personal hygiene nonwoven articles.

General non-limiting examples of household cleaning articles consist of wet and dry wipes and wiping clothes, mop heads and dusters.

General non-limiting examples of personal hygiene nonwoven articles consist of diapers, both for infants and incontinent adults or children, training pants, female pads or panty liners and dry or wet wipes.

A particular non-limiting example of personal hygiene articles to be made from the nonwoven webs of the present invention would be personal or baby care wet wipes. Wet wipes usually consist of sheets of the nonwoven webs impregnated with a lotion stored in scaled packages to prevent loss of lotion through evaporation. Typical lotions are predominantly water based and can contain a wide variety of other ingredients. These are usually, surfactants, humectants, emollients, cleansers, anti-microbials, preservatives, perfumes, and softeners.

Without wishing to be bound by theory is believed that cleaning products formed from nonwovens containing high surface area fibers of the present invention will also make more effective cleaning agents, both for personal and household use. The increased area of the fibers provides both an increase in friction and an increased opportunity for dirt particles to become trapped on and bound to the surface structure of the fibers.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Test Methods

Initial Tensile Strength Test

The nonwoven webs were tested according the procedure outlined in EDANA 20.2-89. The webs were tested "wet" (impregnated with a lotion) to simulate a typical wet wipe type product. The lotion used was 96% water with the following minor ingredients, Sodium Dihydrogenphosphate monohydrate 0.2%, Disodium EDTA 0.1%, Aloe Barbadensis 0.05%, Xanthan Gum 0.2%, Trilaureth-4 Phosphate 0.4%, Bis-PEG/PPG-16/16 PEG/PPG Dimethicone Caprylic, capric triglyceride 0.1%, Propylenglycol 1.5%, Methylparaben 0.15%, Ethylparaben 0.05%, Propylparaben 0.05%, Phenoxyethanol 0.8% and PEG-40 Hydrogenated Castor Oil 0.4%. Lotion loading was 300% of the dry weight of the web.

The lotion was applied to nonwoven webs as follows:

A sheet of dry substrate was weighed and immersed in the requisite amount of cleaning lotion, based on sheet weight and the targeted lotion load. A hand roller was used to evenly distribute the lotion throughout the sheet. The saturated substrate sample was then weighed again to measure the total weight. The saturated sample was then stored in a ZIPLOG bag until they were tested for mechanical properties in order to prevent drying. The steps 1 to 3 were repeated with additional sheets until sufficient substrate samples were treated for the mechanical tests.

Measurement of Cotton Fiber Specific Surface Area

The specific surface area of the cotton fibers was measured utilising the technique of Kaewprasit et al. (Journal of Cotton Science, 2, pp: 164-173, 1998). The method utilizes the adsorption of methylene blue (3,7-bis-dimethylamino-phenothiazin-5-ium ion) in a liquid phase to determine the specific surface area. A known mass of cotton fibers was added to a methylene blue solution of known concentration and brought to equilibrium at 25° C. The amount of methylene blue adsorbed onto the cotton fibers was calculated from the difference between the methylene blue concentration in the solution before and after adsorption onto the cotton fibers.

The methylene blue concentration in the solution was analyzed by measuring the absorbance at 660 nm, i.e., the wavelength corresponding to the maximum absorption peak of methylene blue monomer, with a spectrophotometer. The methylene blue concentration is calculated based on a calibration curve of optical densities against methylene blue concentration obtained by using standard methylene blue solutions of known concentration The adsorption profiles for methylene blue on the cotton surface are of the Langmuir type as monolayer coverage can be inferred from the adsorption profile. The quantity of methylene blue adsorbed increases with the concentration of methylene blue until saturation point. Once the surface saturates increasing the methylene blue concentration does not cause additional material to adsorb onto the fibers.

The specific area of the cotton fibers can then be calculated using the Langmuir equation.

$$Y = \frac{KC}{(1 + KC)} \quad \text{Equation 1}$$

Where Y is the fraction of the cotton surface covered by the adsorbed methylene blue molecules, K is a constant and C is the equilibrium methylene blue solution concentration.

For the present study, $Y = N/N_m$ where N=number of moles of methylene blue adsorbed per gram of cotton and $N_m$=the number of moles of methylene blue required for monolayer coverage.

Making the substitution and rearranging gives Equation 2.

$$\frac{C}{N} = \frac{C}{Nm} + \frac{1}{KNm} \quad \text{Equation 2}$$

A plot of C/N against C gives a straight line with a slope equal to Nm and an intercept equal to 1/KNm. Once the number of moles of methylene blue required to provide a monolayer coverage to the cotton fiber has been determined, the specific surface area can be calculated via Equation 3.

$$S_{MB} = \frac{N_g \times a_{MB} \times N \times 10^{-20}}{M} \quad \text{Equation 3}$$

In Equation 3; $S_{MB}$ is the specific surface area in $m^2/g$, $N_g$ is the number of molecules of methylene blue adsorbed at equilibrium in g/g ($N_g = N_m \times M$), $a_{MB}$ is the occupied surface area of one molecule of methylene blue, 197.2 $Å^2$, N is the Avogadro's number, $6.023 \times 10^{23}$, and M is the molecular weight of dehydrated methylene blue, 319.857 g/mol.

This method was chosen because it is simple to carry out and the technique has been widely used for the specific surface area determination of various natural solids, activated carbon, graphite and silica for example.

Experimental Procedure for the Measurement of the Specific Surface Area of the Fibers Ten different molar concentration methylene blue solutions were prepared using hot water to dissolve the dye and then diluted to the required volume with cold water. Then the flasks were placed in the sonic cleaner for 10 minutes and then placed on the magnetic stirrer for 30 minutes to assure complete dissolution of the dye.

1. Each solution with different methylene blue concentration was sampled and its absorbance was measured by spectrophotometer to determine the exact concentration level on the basis of the calibration curve.
2. Cotton samples were first completely opened by a Shirley Analyzer, untangling the fibers and resulting in an open web of fibers
3. The samples of cotton were conditioned at standard conditions (relative humidity of 65±2% and temperature of 21±1° C.) for at least 24 hours.
4. 10×1.00 g samples of conditioned cotton were weighed and placed in plastic bags.
5. Each of the 10 different concentrations of methylene blue solution was added to one of the 10 weighed cotton samples. Note: Each of the 10 different molar concentrations of methylene blue was agitated in the sonic cleaner for 10 minutes and then on the magnetic stirrer for 15 minutes before being added to the cotton and/or sampled for concentration.
6. Each sample comprising the cotton and the 50 mL of methylene blue was agitated for 2 minutes.
7. The beaker was covered with parafilm and placed in a 25° C. water bath shaker for 24 hours.
8. After 24 hours, the appropriate dilutions of the shaken solutions were made up and the absorbance of the methylene blue that remains in solution was measured at 660 nm.

The difference in molar concentrations of the samples in step 1 and step 8 gave the molar concentration absorbed by the cotton. From the molar concentration the grams of methylene blue adsorbed per gram of cotton were calculated. A graph of grams of methylene blue/grams cotton fibers against molar concentration of methylene blue then allowed the determination of the molar concentration of the monolayer of methylene blue.

With this data, the specific area of the cotton was calculated using Equation 3.

The calibration curve obtained for methylene blue absorbance at 660 nm against concentration used in the calculations of the surface area is shown in FIG. 1.

Figure 2:
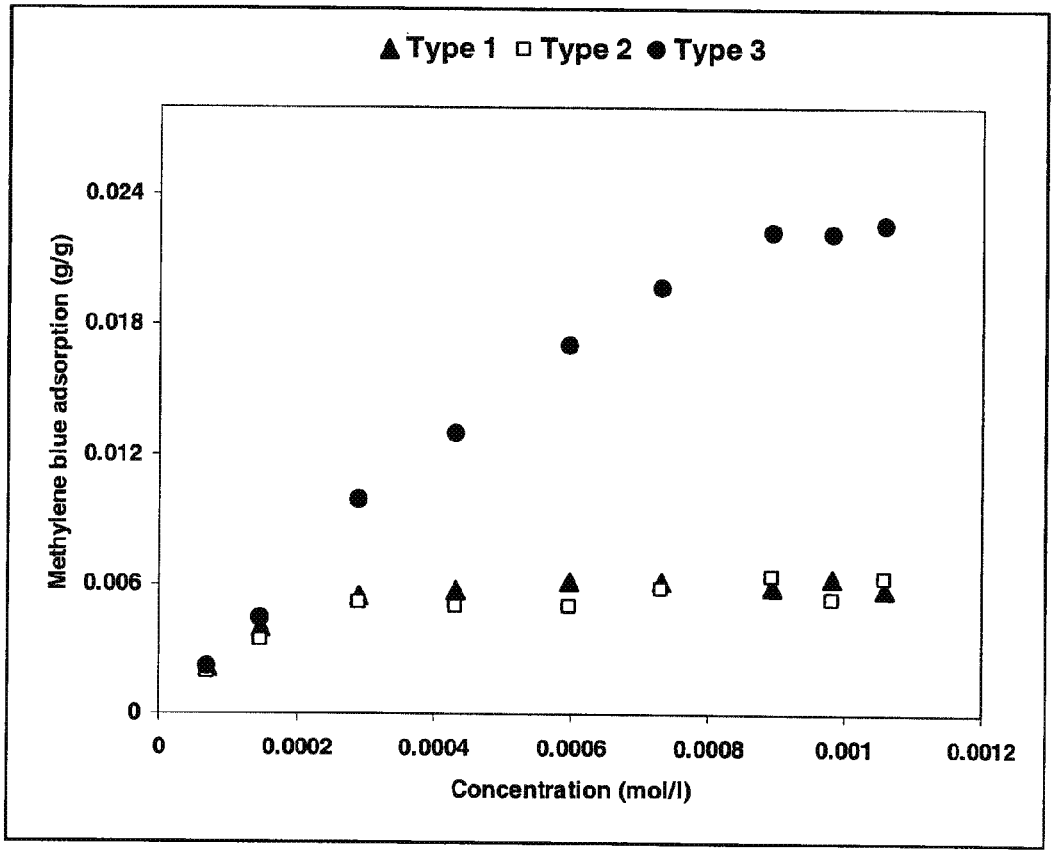
FIG. 2 shows the adsorption isotherms of methylene blue on the fibers.

The adsorption isotherms of the three different cotton types are graphically represented in FIG. 2. Type 1 fibers are Sample 1 fibers, Type 2 fibers are Sample 2 fibers and Type 3 fibers are treated fibers. The data points on this graph are an average of three independent experimental replications.

Treatment Procedure for Cotton Fibers

A sample method to produce high specific surface area fibers for use in the present invention is out lined below.

1. 1100 kg of cotton fibers with a specific surface area of 17 $m^2/g$ was added to 4000 L of water. 20 kg of caustic (98% NaOH), 5 kg Aktud® PR and 10 kg of Cottoclarin® was added and the mixture was heated to 95° C. and stirred for 15 minutes. The mixture was then washed with water and then a 0.75 g/L Foryl® in water solution and then with water again. All the washing steps were carried out at 85° C.
2. The material was then taken up again in 4000 L of water. 10 kg of caustic (98% NaOH), 5 kg of Aktud® PR and 2 kg of Cottoclarin® was added and the mixture was heated to 90° C. and stirred for 10 minutes. The mixture was then washed as carried out in step 1.
3. The material was then taken up again in 4000 L of water. 10 kg of caustic (98% NaOH), 5 kg of Aktud® PR and 2 kg of Cottoclarin® was added and the mixture was heated to 90° C. and stirred for 10 minutes. The mixture was then washed as carried out in step 1.
4. The batch was then neutralised with acetic acid to pH 6.5-7.0. The batch was then further washed with a 4000 L of water containing 15 kg of Foryl® and 7 kg of Securon® DC at 80° C. for 10 minutes. The mixture was then washed with water at 80° C.

5. The batch was then taken up in 4000 L of water. 400 kg of sodium hypochlorite and 10 kg of soda was added and the batch was stirred for 40 minutes at 55° C. The batch was then washed with water for 10 minutes at 80° C. and a 4000 L solution of water with 10 kg of Securon® 590 at 80° C. for 12 minutes.
6. The batch was then taken up in 4000 L of water. Then 15 kg of caustic, 5 kg of Cottoclarin®, 5 kg of Securon® DC and 35 kg of hydrogen peroxide (50% $H_2O_2$) were added and the mixture was stirred first at 95° C. for 5 minutes and then at 110° C. for 15 minutes.
7. The batch was then washed with water at 40° C., a solution of 10 kg of Securon® 590 in 4000 L of water for 5 minutes at 40° C. and finally a solution of 2 kg of Setilon® KNL in 4000 L of water for 5 minutes at 40° C.

The resulting cotton fibers have a specific surface area of >75 $m^2/g$ when tested in the methylene blue adsorption method (detailed below).

Cottoclarin®, Securon® DC, Setilon® KNL and Foryl® are chemicals available from the COGNIS chemical company. Aktud® PR is a redactor agent from Akkim Kimya Sanayi A.S. chemical company.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A non-woven web comprising: (a) between about 40% and about 60%, by weight of the non-woven web, of treated, high surface area cotton fibers with a specific surface area of at least 55 $m^2/g$; and a second fiber selected from the group consisting of viscose fibers, rayon fibers, polyester fibers, cotton fibers, wood fibers, and polypropylene fibers.

2. The non-woven web of claim 1 wherein the high surface area cotton fibers have an average length of greater than 5 mm.

3. The non-woven web of claim 1 wherein the high surface area cotton fibers have a specific surface area of at least 65 $m^2/g$.

4. The non-woven web of claim 3 wherein the high surface area cotton fibers have a specific surface area of at least 75 $m^2/g$.

5. An absorbent article comprising a non-woven web, wherein the non-woven web comprises: (a) between about 40% and about 60%, by weight of the nonwoven web, of treated, high surface area cotton fibers with a specific surface area of at least 55 $m^2/g$; and a second fiber selected from the group consisting of viscose fibers, rayon fibers, polyester fibers, cotton fibers, wood fibers, and polypropylene fibers.

6. The absorbent article of claim 5 wherein the absorbent article is selected from the group consisting of diapers, training pants, wet and dry wipes, female hygiene pads and tampons.

7. The absorbent article of claim 5 wherein the absorbent article is selected from the group consisting of wet and dry wipes.

* * * * *